US005967216A

United States Patent [19]

Mancini

[11] Patent Number: 5,967,216

[45] Date of Patent: Oct. 19, 1999

[54] DOOR REINFORCEMENT APPARATUS

[76] Inventor: Luciano Mancini, 8200 NW. 66 Ter., Tamarac, Fla. 33321

[21] Appl. No.: 08/964,093

[22] Filed: Nov. 4, 1997

[51] Int. Cl.[6] ..... E05D 15/00

[52] U.S. Cl. ..... 160/209; 52/167.1

[58] Field of Search ..... 160/209, 201, 160/202, 222, 33, 35, 36, 37; 292/DIG. 36, 300, 36, 38; 52/167.1, 167.3, 127.2, 741.3, DIG. 12; 403/337, 347; 211/105.1, 87.01; 248/231.91

[56] References Cited

U.S. PATENT DOCUMENTS

| | | | |
|---|---|---|---|
| 1,581,805 | 4/1926 | Kirsch | 211/87.01 X |
| 3,424,223 | 1/1969 | Rosenblatt | 160/209 |
| 3,443,625 | 5/1969 | Moser et al. | 160/181 |
| 3,853,166 | 12/1974 | Wrono | 160/201 X |
| 4,723,880 | 2/1988 | Stumpf, Jr. | 211/87.01 X |
| 5,383,509 | 1/1995 | Gaffney et al. | 160/209 |
| 5,445,209 | 8/1995 | Romanelli et al. | 160/209 |
| 5,620,038 | 4/1997 | De Cola et al. | 160/209 |
| 5,732,758 | 3/1998 | Marko | 160/201 |

*Primary Examiner*—Blair M. Johnson
*Attorney, Agent, or Firm*—Manuel R. Valcarcel

[57] ABSTRACT

A door reinforcement apparatus for mounting on the interior side of various types of doors, whether side opening or vertical opening, combining ease of use and simplicity of design with added security and strength to the door where installed, comprising an adjustable mounting bracket having a first plate with one or more holes running perpendicularly through said coplanar surfaces of said first plate for insertion of mounting bolts for fastening of said adjustable mounting bracket to the wall surface above the door being reinforced, said adjustable mounting bracket also having a second plate perpendicularly connected to said first plate's, said second plate having one or more holes; and a beam having one or more fastening holes near its upper end for insertion of bolts when aligned with said connecting holes of said second plate of said adjustable mounting bracket, said beam further including an integral bottom mounting plate disposed perpendicularly to the rest of said beam at said bottom end of said beam, said integral bottom mounting plate having one or more holes for insertion of mounting bolts and fastening thereby to the interior floor surface adjacent to said door.

3 Claims, 6 Drawing Sheets

DOOR REINFORCEMENT APPARATUS

BACKGROUND OF THE INVENTION

1. Field of the Invention

The present invention relates in general to a door reinforcement apparatus for mounting on structural surfaces adjacent to the interior side of various types of inward or upward opening doors, combining ease of use and installation and simplicity of design with added security and strength to the door where installed. The present invention is particularly useful for reinforcing wide doors such as garage doors, but its simplicity of design allows for use in reinforcement of most types of doors, an attribute not possessed by the prior art. It also addresses the need for reinforcement against inward forces such as those produced by windstorms as well as against intruders.

2. Description of the Related Art

In recent years, due to several major hurricanes which ravaged the southeastern United States, there has been renewed attention given to improving structural strength of buildings to withstand the high wind forces. The building codes in several major metropolitan areas in this region of the United States have been revised to now require some type of reinforcement or protection of building walls and apertures against wind forces. Windows and glass doors need to be covered with panels or other protective coverings to resist breakage due to flying debris. The panels or protective coverings are generally designed to withstand inward forces through the type and thickness of materials used, the framing or tracks used in installation, and the use of strength-increasing corrugation.

In situations involving doors covering larger-dimension openings the need for reinforcement is not directed so much to preventing breakage due to flying debris. Instead, the need for reinforcement is directed towards preventing collapse of the door assembly because of its inability to withstand inward forces directed at the central areas of the wide-dimension door. In this regard, such doors are susceptible to various types of inward forces, including not only wind forces but also forces applied by intruders seeking entry into a building. This is because the doors themselves are usually made of materials strong enough to withstand impacts from flying debris, but are not made of sufficient thickness to resist inward forces because the resulting doors would be too heavy to handle and too expensive. Thus, reinforcement for these types of large-dimension openings is preferably in the nature of bracing to prevent inward or other flexing movement of the door rather than coverings or thicker materials for the doors.

One of the most common examples of a larger-dimension door which must be reinforced is the typical garage door, which consists of several horizontal panels hinged together and operates vertically using rollers which engage tracks aligned at each vertical side of the door. Such doors are usually made of aluminum, wood or even fiberglass materials which would likely be able to withstand impacts from flying debris in a windstorm provided that they can resist inward wind forces directed at their central portions. Without reinforcement, it has been found that when such doors are exposed to forces such as those produced by high velocity windstorms, the doors tend to buckle inward and can separate from their frames or tracks, thereby allowing such forces to enter the building and cause damage. Such unreinforced doors can also be breached by intruders applying force against such doors' central area, thereby loosening the door from its tracks enough to disengage its locking mechanisms. Other types of larger-dimension doors which are susceptible to inward buckling due to forces applied to their central areas include side opening doors used in warehouses and structures such as hangars, and side-by-side double entry doors used in residential and commercial buildings, which have a weak point typically consisting of a thin wood or metal molding secured at the edge of one of the doors adjacent to the edge of the other door, where the locks of one door engage the other door, and where adjustable and lower bolts are typically located, which bolts are inserted upwardly and downwardly into the door frame and the floor threshold, respectively. These double doors are vulnerable at this center vertical molding because inward forces can cause the comparatively thin and therefore weak molding to crack or split, resulting in the doors being breached.

Large-dimension door reinforcement assemblies should be as simple as possible to install, maintain and store, while also be as economical as possible so that they have more widespread usage, resulting in a greater number of reinforced doors and, in turn, reduce the chances of break-ins by intruders and, lower chances of door failures caused by windstorms which could cause collateral damage to other property by becoming projectiles in such storms.

Efforts to address reinforcement needs of large-dimension doors such as the typical garage door have resulted in various forms of reinforcement apparata, each of which has its benefits but which also suffer from several practical flaws. Garage doors are now usually required to be reinforced by installation of horizontal beams made of wood (typically 2"×4" beams) or metal fastened to the horizontal door panels of such doors by means of "U" shaped brackets bolted to such door panels. Such beams are intended to stiffen the panels and prevent them from warping when forces are applied inwardly against the door. Unfortunately, such beams add considerable weight to the door, requiring adjustment of the door spring mechanism tension and straining the automatic garage door opener drive mechanism commonly used in connection with such doors, resulting in gradual wear and tear of such mechanism to the point where it may later break down. Furthermore, such beams, while providing some measure of added stiffness to the door, do not effectively secure the door so that it cannot be forced open by intruders or protect against the door itself from separating from its frame due to inward forces, because the horizontal beams do not fasten to the adjacent building structure at all.

Other attempts to address the need for reinforcement of doors against inward forces have also focused on application in situations involving inward forces caused by windstorms while ignoring the need for resistance against intruders, with advances directed to providing reinforcement which can be left mounted on the door. These devices typically can be left mounted on the door, thereby eliminating the need for repeated installation, but the initial installation is cumbersome, requiring considerable skill and tools, and may necessitate the removal or modification of existing above-described horizontal reinforcements. Furthermore, while these devices can be used whenever the door is closed, even when the property occupant is not present, these devices do not provide security against intruders because they disengage whenever the door is opened (whether opened under normal operation or by force). They do not lock in place, and as a result an intruder can force the door to its open position just as if the reinforcement was not present. Additionally, because they are left in place, they add weight to the door and are of necessity made of numerous moving parts, parts which will inevitably wear with time.

Attempts at addressing both the need to reinforce against inward forces caused by windstorms as well as forces caused by intruders are flawed in that they are composed of numerous parts and which can themselves cause damage to the door being reinforced when called upon to resist inward forces applied against the door. Furthermore, these devices employ reinforcing means which are also only applicable to garage doors and are only as effective as the strength of the garage door's materials and fasteners.

Examples of attempts to provide reinforcement against inward forces created by windstorms as well against intruders are U.S. Pat. No. 5,620,038 to DeCola et al. and U.S. Pat. No. 5,383,509 to Gaffney, et al. DeCola discloses a system for bracing garage doors against hurricane force winds which includes a plurality of vertical door stiffening column members which can be made of wood, and uses separate deflection brackets which must be custom-mounted to the door stiffening column members during installation, a process which requires time and skill. The deflection brackets are also adapted to engage the typical garage door panel hinges, which makes them useful only in applications involving garage doors which have such hinges, and not to other types of doors or doors having other types of hinges. The use of deflection brackets was in response to what was the perceived tendency of garage doors to "peel" outwardly from the opening after being loosened from their tracks due to inward forces. Because garage doors are installed so that their top and side exterior edges rest against the frame of the garage opening, thereby providing resistance on these edges against outward forces, this "peeling outward" occurs generally when either the building structure has been breached at some other point, resulting in outward forces being applied against the door or if the door loosens from its tracks due to application of inward forces, which leads to outward forces being applied as a result of the wind turbulence created in the garage. In such situations the deflection brackets will likely prove ineffective because they are only as strong as the sheet metal screws used to fasten the door hinges to the thin metal door panels.

More importantly, the deflection brackets themselves can actually cause considerable damage to the door being reinforced because they connect to the moving parts of the door (its hinges); when inward forces are applied and the deflection brackets are called upon to deflect such forces, they can result in damage or breakage of the hinge, and can even result in perforation of the door panel surface. Furthermore, the use of deflection brackets results in less reinforcing contact between the door and the stiffening member, necessitating the use of multiple vertical stiffening members.

U.S. Pat. No. 5,383,509 to Gaffney, et al. describes a kit for door reinforcement which is also limited in its application to garage doors through its use of one or more "finger-like" members insertable into the hinges of the door. These finger-like members are the points of contact between the door and the reinforcement device, and are intended to provide reinforcement against both inward and outward forces. Because the finger-like members are inserted into the hinges of the garage door, the reinforcement provided is only as strong as the hinge materials and fasteners. Furthermore, the finger-like portions, like the deflection brackets in DeCola, could result in distortion and damage to the hinges and possibly perforation of the door when forces, whether originating from windstorms or from an intruder prying upwardly, are applied. The use of finger-like members to provide reinforcement has the further drawback in that such members can be lost with time and are not likely to be easily replaced because of their specialized application. While they provide a connection between the door and the reinforcement apparatus, the finger-like members do not result in a tight fit between the reinforcement apparatus' surface, the door surface and the surrounding frame, and the door is therefore susceptible to vibration and movement which can ultimately result in a breach of the door.

Accordingly, it is an object of this invention to provide an improved door reinforcement apparatus which provides effective reinforcement against inward forces such as those caused by windstorms as well as added security against intruders by preventing the door from being opened.

It is a further object of this invention to provide an improved door reinforcement apparatus which, because of its improved design, is easily and quickly installed and removed.

Another object of this invention is to provide an improved door reinforcement apparatus which, because of its improved design, can provide long-lasting reinforcement more economically than currently available alternatives and will not damage or distort door components when called upon to resist forces.

Other objects, advantages and features of the present invention will become apparent when the following description is considered in conjunction with the accompanying drawings.

SUMMARY OF THE INVENTION

The present invention addresses a long-felt need for a simple, quickly installed door reinforcement adaptable for use with various types of doors through a reinforcement apparatus preferably comprised of two main parts, namely, a beam with an integral bottom mounting bracket at its bottom end, said integral bottom mounting bracket having one or more holes for insertion of bolts for fastening said beam to the interior floor surface adjacent to the door being reinforced, said beam further including fastening holes its top end, and an adjustable mounting bracket having a first plate and a second plate connected perpendicularly to one side of said first plate, said first plate having one or more holes for insertion of mounting bolts for fastening said adjustable mounting bracket to the wall surface above the door so that the surface of the side of said first plate opposite to the side where said second plate is connected rests against the wall surface. The second plate of said adjustable mounting bracket projects outwardly from the wall surface when the adjustable mounting bracket is mounted to the wall, and said second plate has one or more connecting holes for connection of the adjustable mounting bracket to said beam by alignment of said connecting holes with the fastening slots located near the second end of the beam and insertion of bolts through the aligned holes and slots, and then securing the bolts with nuts or other means.

Simplicity is achieved by the bottom mounting plate which is integral to the beam and additionally preferably by use of slots or elongated holes rather than circular holes as the holes for all connection points of the apparatus' parts except preferably for one circular hole located at the integral bottom mounting plate, where the final bolt is inserted to "lock-in" the reinforcement apparatus. Various combinations of open slots, elongated holes and circular holes can be used to increase or decrease adjustability. The adjustable mounting bracket is fastened to the wall above the door and the connecting holes on the second plate of the adjustable mounting bracket are aligned with appropriate fastening slots near the end of the beam so that the planar surface of the beam nearest to the door rests snugly against the door surface, thereby preventing vibration or inward movement of the door. Upward movement of overhead-opening doors is also prevented by the installation of the adjustable mounting bracket on the wall above the door so that when connected to the beam the door's path is blocked.

The dimensions of the beam and the adjustable mounting bracket are designed to correspond to the typical height and thickness of the particular type of door with which the invention is to be used, such as the typical front door of a residence or commercial building or garage doors, whether of the overhead-opening or side-opening type, so that the beam is long enough to attach to the interior floor adjacent to the door as well as to the wall surface above the door. The second plate of the adjustable mounting bracket which extends outwardly from the wall surface when the adjustable mounting bracket is mounted on the wall surface above the door being reinforced is similarly designed to be long enough for its connecting holes to align with the fastening slots of the beam so that fasteners can be inserted through both, while also allowing for the planar surface of the beam nearest to the door to rest snugly against the inner surface of the door, thereby providing the desired reinforcement.

The reinforcement apparatus can be installed at any point along the width of the door being reinforced and still provide reinforcement, although optimum reinforcement for wide doors which are susceptible to bending or warping can be achieved by positioning the reinforcement apparatus at or near the approximate horizontal center of the door. Furthermore, the invention, when installed in applications involving inward-opening doors, whether of the overhead opening or side-opening type, prevents the door from being forced to its open position, thereby providing increased security against intruders.

From the foregoing it will be apparent that the present invention is not only simple in construction but also that its installation can be completed in a matter of minutes by a single person without necessity of any special skills. Additionally, there is little chance that any parts will be lost when the invention is stored and not in use because the adjustable mounting bracket remains mounted at all times, with the mounting bolts used to fasten the adjustable mounting bracket to the beam also inserted through the slots of the adjustable mounting bracket. Similarly the bolts used to fasten the beam to the floor adjacent to the door can be left screwed into the floor mounting holes of the integral bottom mounting bracket. The beam, which is the only other part of the invention, can be stored vertically or horizontally either above or next to the door, or in another convenient location; regardless of how stored, the beam is not a part likely to be misplaced or lost. Although the invention is preferably installed vertically, it can provide effective reinforcement even when installed horizontally near the horizontal center area of the door.

Various rigid materials can be used for the components of the present invention, including metals, wood, rigid plastics, and other materials capable of withstanding the types of forces contemplated. Because there are no moving parts and the design is rigid and sturdy throughout to withstand considerable forces, there is little chance of breakage of parts. The present invention allows for more surface area of the beam to contact the door surface to provide reinforcement, thereby in effect dividing the door into substantially smaller areas subject to the inward forces and thus rendering the door capable of withstanding substantial forces while at the same time preventing any vibrational movement that could cause the door to loosen from its hinges or its tracks, which loosening could lead to the "peeling outward" effect.

In applications such as the typical garage door, one additional embodiment of the invention includes the optional use of strapping means, such as one or more plastic cable ties like those used in electrical/electronic installations and which are now increasingly being used by police officers as disposable "keyless" handcuffs, or alternatively belt(s) which can be of natural or synthetic materials, and which can employ various forms of buckles, to secure the beam of the apparatus to the garage door's horizontal reinforcement members or directly to the door panels. Such strapping means are inexpensive and easy to find in stores, making them easily replaceable. Additionally, they are strong enough to withstand considerable forces, and therefore provide additional reinforcement to the door in situations where the structure wherein the door being reinforced is installed has been breached in another area, causing forces to be applied outwardly against the interior of the door. More importantly, because such strapping means are flexible, they will not cause damage to the door when called upon to resist outward forces, which is a major improvement over the use of deflection brackets or finger-like members. They also provide greater reinforcement because they attach to the door panels or the horizontal members, not to weaker areas such as hinges that are attached with sheet metal screws having threads which can be easily stripped.

Various additional refinements can be included, such as using a "T"-shaped beam having a longitudinal beam portion and a second longitudinal beam portion extending perpendicularly outward from the center of said first longitudinal beam portion to create such "T" shape along the beam's length, with a vertical slot through said first longitudinal beam portion near the upper end of the beam for insertion of the second plate of the adjustable mounting bracket and fastening to the fastening slots of the beam, which in this embodiment are located on the second longitudinal beam portion area aligned with the slot through the first longitudinal beam portion. This refinement adds to the strength and stability of the connection of the adjustable mounting bracket to the beam. Additionally, the adjustable mounting bracket can be further refined by also connecting the first and second plates to form a "T" for increased strength, with one mounting slot of the first plate located on one side of the second perpendicular plate, and the other mounting slot located on the other side of the second perpendicular plate.

The invention is highly effective for preventing forced breach of large-dimension doors, and because only one unit is needed per door in order to achieve effective reinforcement against inward forces, the cost of the device is kept within reasonable limits and only a fraction of what it would cost to replace the a large-dimension door.

DESCRIPTION OF THE PREFERRED EMBODIMENTS

Figure 1:
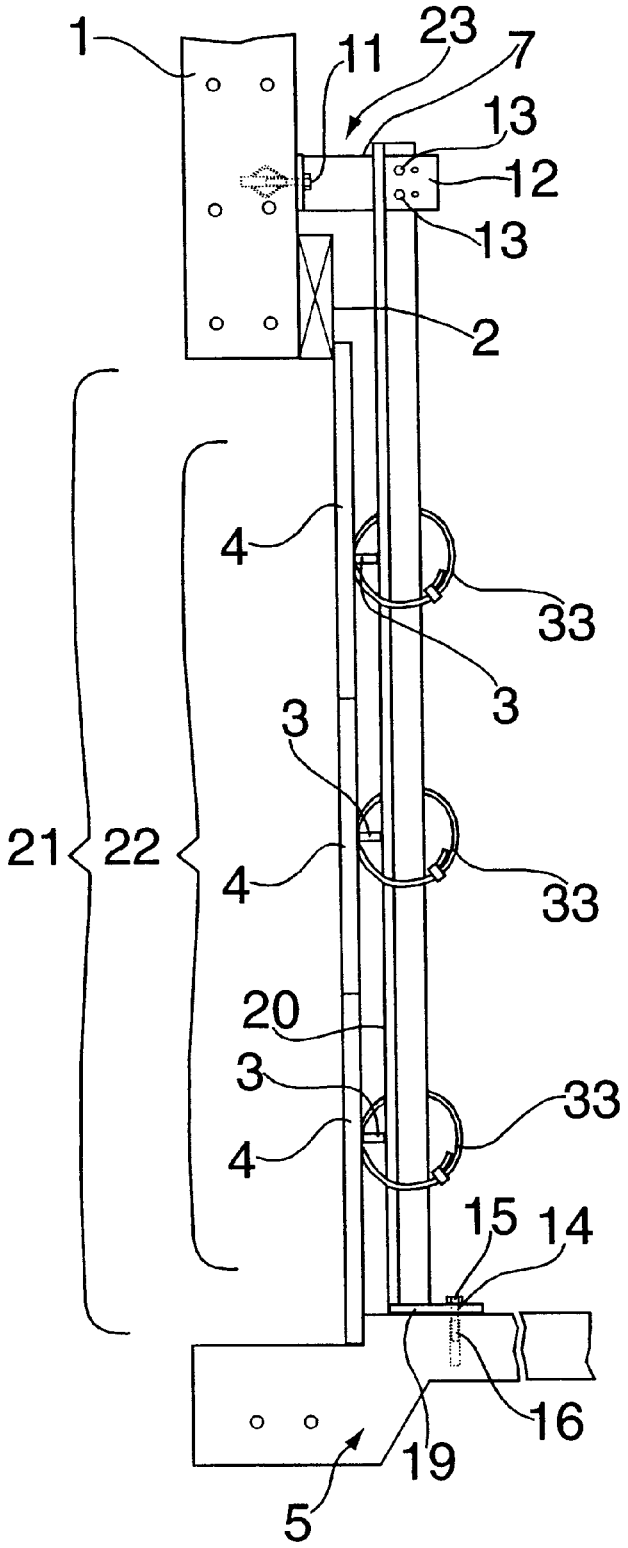
FIG. 1 is a side view of the door reinforcement apparatus as mounted to the wall surface above the door and to the interior floor surface adjacent to the door, with the vertical surface of the beam adjacent to the door resting against the door and depicting the use of flexible strapping means to fasten the beam to the door and depicting the use of flexible strapping means to fasten the beam to the door.

Referring to FIG. 1, one embodiment of the present invention is presented as installed to reinforce the typical garage door 22. The beam 6, in the "T"-shaped embodiment, having an integral bottom mounting plate 19 is installed on the interior side of garage door 22 resting snugly against the garage door panels 4. The beam 6 includes a slot 8 near its upper edge, for insertion of second plate 12 of the adjustable mounting bracket 23. The adjustable mounting bracket 23 is comprised of a first plate 7 and a second plate 12, said second plate having one or more connecting holes 13 running perpendicularly through its planar surface and disposed along its length for adjustable fastening to the beam 6 when said second plate 12 is inserted through the slot 8 using mounting bolts 15 and nuts 24. The adjustable mounting bracket 23 is mounted to the wall 1 above the opening 21 by fastening the said first plate 7 of said mounting bracket 23 to said wall 1 inserting mounting bolts 11 through the right slot 9 and left slot 10 of said mounting bracket 23 and into anchors 16 inserted into the wall 1. The integral bottom mounting plate 19 is fastened to the interior floor 5 adjacent to the door 22 by insertion of a mounting bolt 15 through the integral bottom mounting plate mounting slot 18 and into an anchor 16 inserted into said floor 5, and is finally locked into place by insertion of a mounting bolt 15 through the circular mounting hole 14 of said integral bottom mounting plate 14 and into an anchor 16 inserted into said floor 5. The vertical surface 20 of the beam 6 rests snugly against either the door panels 4 or the horizontal door panel reinforcements 3, as the case may be, thereby providing reinforcement against inward forces and with the use of flexible strapping means 33 provides reinforcement against outward forces without damaging the door's parts. The reinforcement device also provides added security against intruders by effectively preventing the door, (in FIG. 1, the garage door 22) from being moved to the open position.

Figure 2:
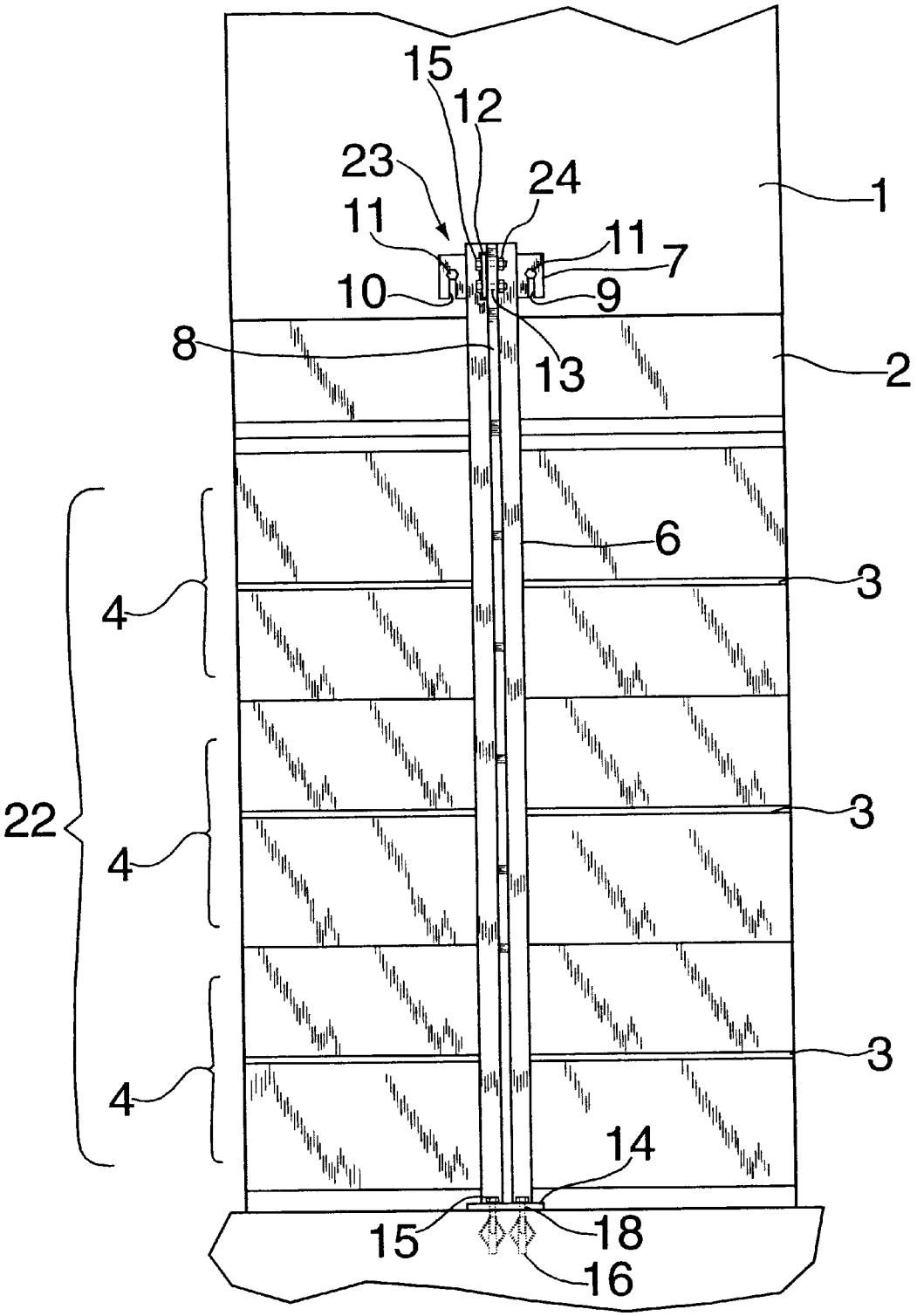
FIG. 2 is a front view of the door reinforcement apparatus, as mounted to the wall surface above the door and to the interior floor surface adjacent to the door.

Referring now to FIG. 2, a front view of the reinforcement device is depicted, again as would be installed on the typical garage door 22, showing the right slot 9 and left slot 10 of the adjustable mounting bracket 23, and the disposition of the first plate 7 and the second plate 12 of said adjustable mounting bracket, as well as the integral bottom mounting plate 18 and the mounting bolts 15 inserted into the interior floor 5 of the building adjacent to the garage door 23. In FIG. 2 the "T"-shaped embodiment of the beam 6 is again depicted.

Figure 3:
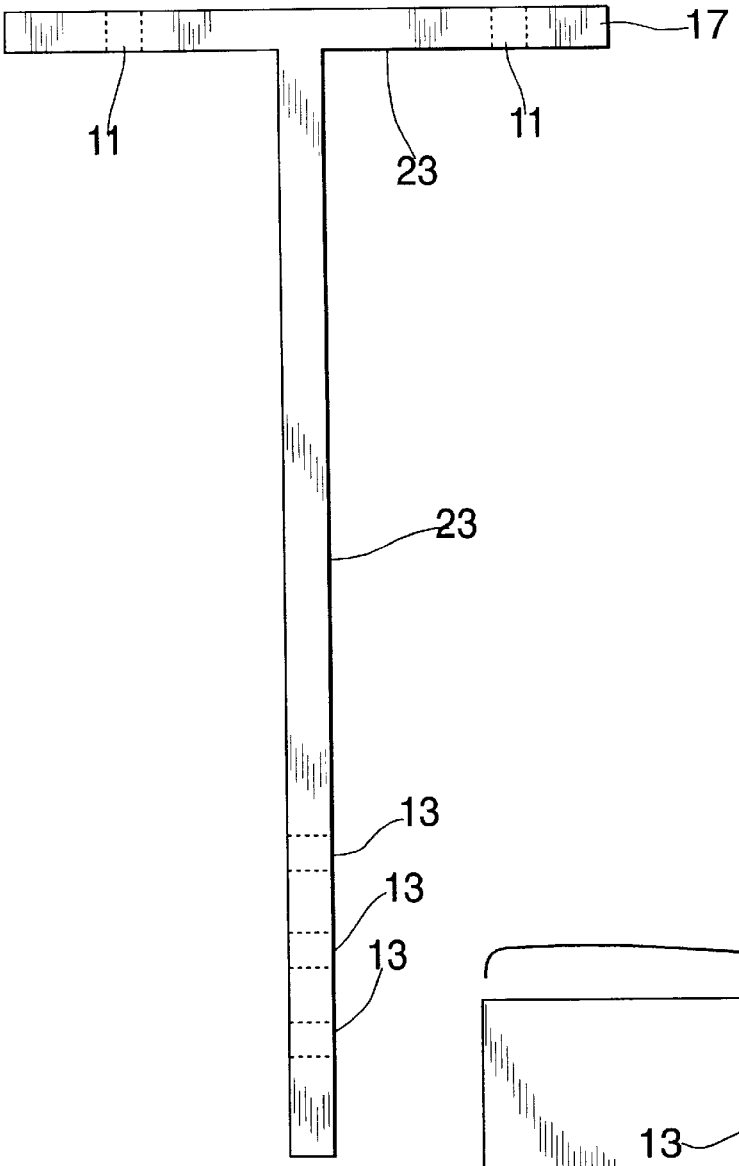
FIG. 3 is a top view of the adjustable mounting bracket.

A top view of the adjustable mounting bracket 23 is depicted in FIG. 3, again showing the configuration of the first plate 7 and the relatively longer second plate 12, also showing the relative disposition of the right slot 9 and the left slot 10 of the first plate 7, which is where mounting bolts 15 would be inserted for fastening said first plate 7 of the adjustable mounting bracket to the wall 1 above the door. FIG. 3 also shows the disposition of the connecting holes 13 located on the second plate 12 of the adjustable mounting bracket 23. The first plate 7 can be shorter than the second plate 12 and still provide effective mounting, while the second plate 12 is preferably of a length sufficient to allow for adjustable attachment with the mounting holes of the beam 6 which are aligned with the slot 8 of said beam, thereby permitting usage of the device with doors of various thicknesses, whether or not they include horizontal reinforcement bars.

Figure 4:
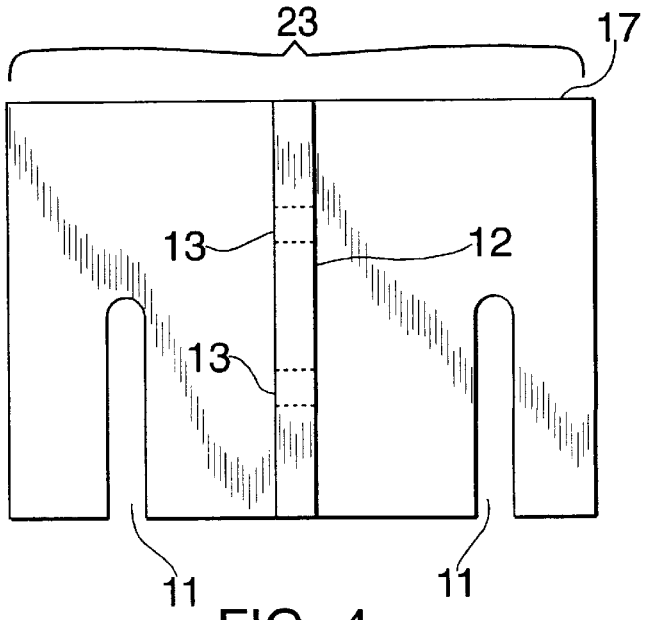
FIG. 4 is a front view of the adjustable mounting bracket.

FIG. 4 depicts a frontal view of the adjustable mounting bracket 23, clearly showing the use of right slot 9 and left slot 10 for quick installation, and the perpendicularity of the first plate 7 in relation to the second plate 12 of said adjustable mounting bracket 23.

Figure 5:
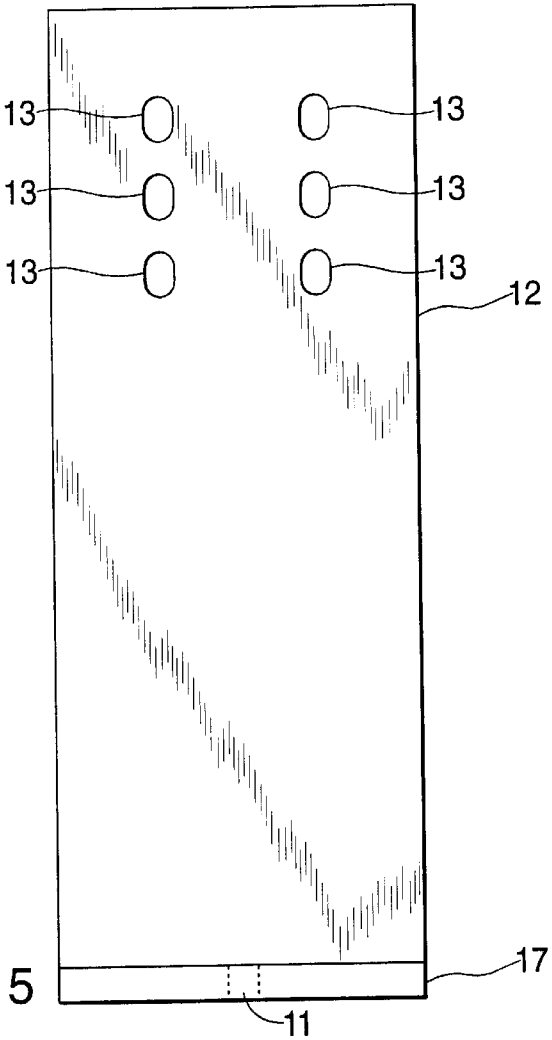
FIG. 5 is a side view of the adjustable mounting bracket.

FIG. 5 depicts a side view of the adjustable mounting bracket 23 showing the disposition of the fastening holes 13 located on the second plate 12 of the adjustable mounting bracket 23.

Figure 6:
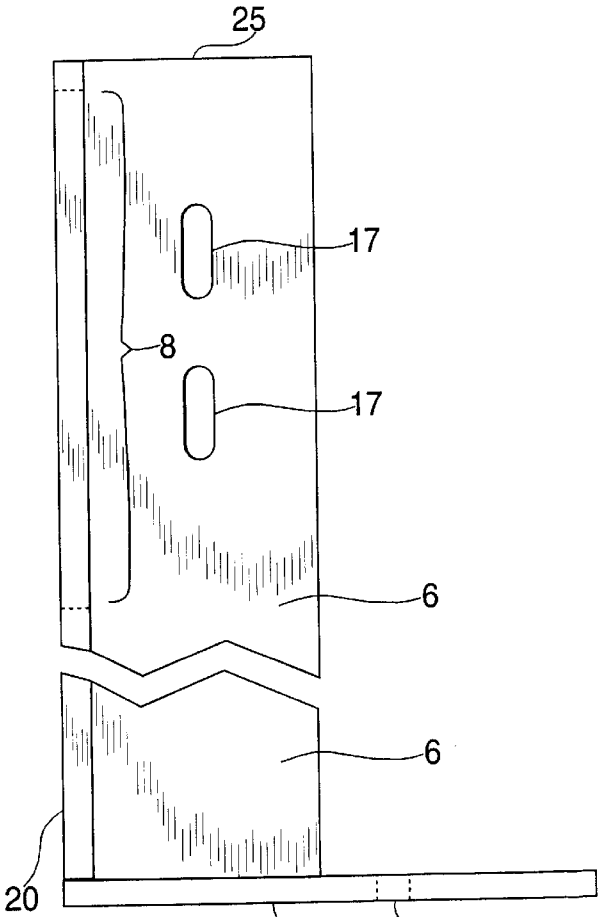
FIG. 6 is a side sectional view of the beam in the "T"-shaped embodiment.

FIG. 6 shows the beam 6 from a side sectional view, showing the integral bottom mounting plate 19 with its mounting hole 14, its fastening slots 17 near its adjustable edge, which fastening slots are intended to be aligned with the connecting holes 13 of the second plate of the adjustable mounting bracket 23 when said second plate 12 is inserted through slot 8 near the upper edge of beam 6. The surface 20 of beam 6 is the surface which rests snugly against the interior surface of the door being reinforced.

Figure 7:
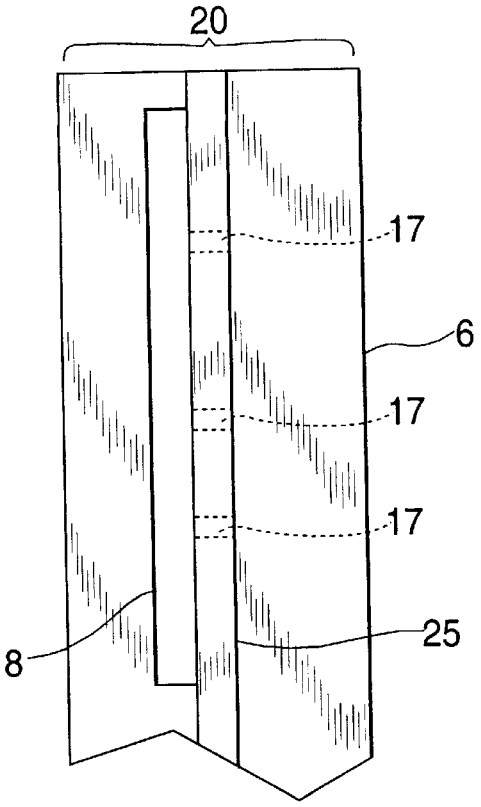
FIG. 7 is a front sectional view of the "T"-shaped beam, showing the slot located adjacent to said beam's adjustable edge for insertion of said second plate of said adjustable mounting bracket.

FIG. 7 depicts the upper portion of beam 6 from a frontal sectional view, showing the slot 8 for insertion of the second plate 12 of the adjustable mounting bracket 23. FIG. 7 also shows the disposition of fastening holes 17 on the beam 6, in the preferred embodiment of beam which is T-shaped, on the perpendicular surface 25.

Figure 8:
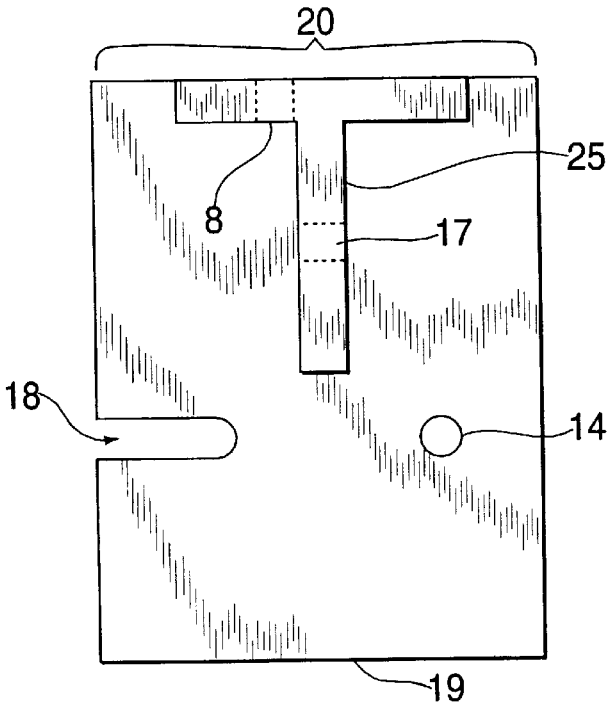
FIG. 8 is a top view of the "T"-shaped beam, showing the integral bottom mounting plate, with its mounting slot and locking mounting hole, also from a top view.
Figure 9:
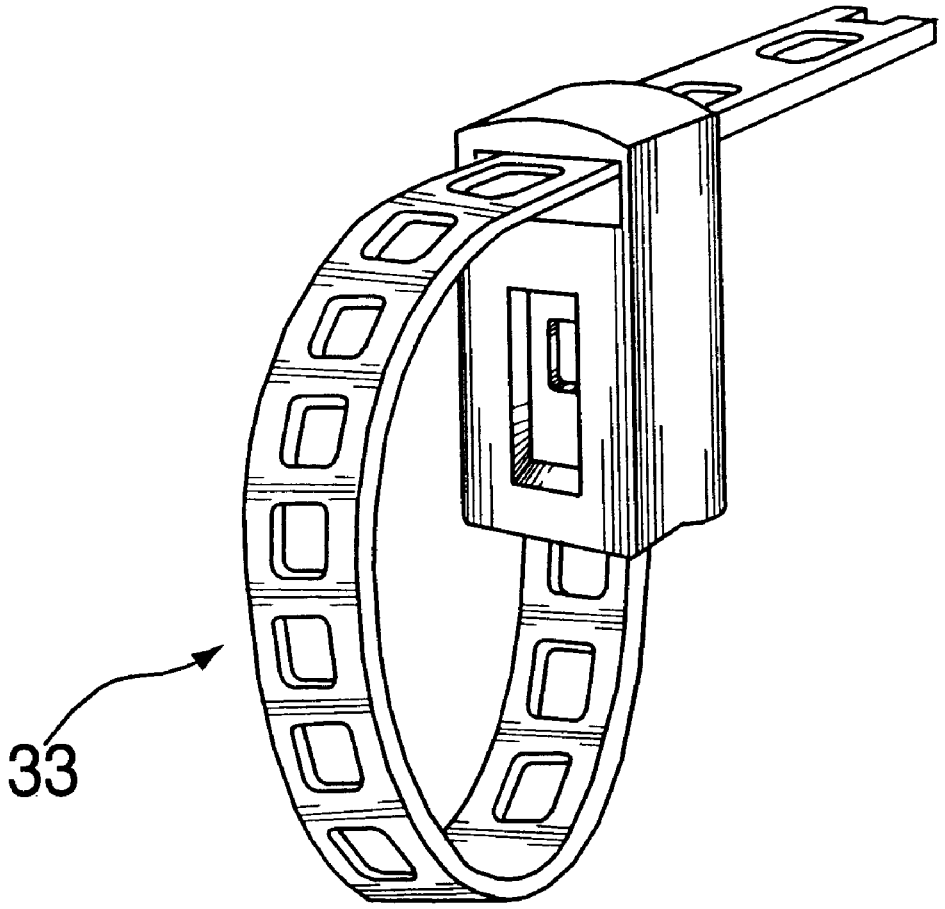
FIG. 9 depicts one example of flexible strapping means 33.

FIG. 8 depicts the beam 6 from a top view, showing integral bottom mounting plate 19, mounting slot 18 for easy connection to the floor 5 with mounting bolts 15, circular mounting hole 14 which is the only attachment point which is not a slot, and which is therefore the final "locking" point of the device. FIG. 8 also shows the reinforcing surface 20 of the beam 6, the disposition of slot 8 through which second plate 12 of adjustable mounting bracket 23 is inserted and fastened by bolts 11 inserted through fastening holes 13 and through fastening holes 17 on the upper end of beam, and then secured with nuts 24.

While the present invention has been shown and described herein with selection of specific dimensions in what are considered to be the preferred embodiments thereof, illustrating the results and advantages over the prior art obtained through the present invention, the invention is not limited to those specific embodiments. Thus, the forms of the invention shown and described herein are to be taken as illustrative, and changes in the dimensions to adapt the present invention to specific door applications may be made and alternate or optional embodiments selected without departing from the spirit and scope of this invention.

Having thus described the invention, I claim:

1. A door reinforcement apparatus comprising an upper mounting bracket having a first plate with one or more holes for insertion of mounting bolts to fasten said upper mounting bracket to the wall surface above the door being reinforced, and having a second plate perpendicularly connected to said first plate, said second plate having one or more holes;

a beam having a first longitudinal portion and a second longitudinal portion extending perpendicularly outward from the center of said first longitudinal beam portion to form a "T" shape, said beam also having a hole through said first longitudinal beam portion at said upper end adjacent to said second longitudinal beam portion for receiving said second plate of said upper mounting bracket, said beam also having one or more holes disposed through said second longitudinal beam portion near its upper end for insertion of bolts when said holes are aligned with said holes of said second plate of said upper mounting bracket, said beam further having an integral bottom mounting plate disposed perpendicularly to the rest of said beam at the bottom of said beam, said integral bottom mounting plate having one or more holes for insertion of mounting bolts and fastening to the interior floor surface adjacent to the door being reinforced such that said beam rests snugly against the interior surface of said door to provide reinforcement; and flexible strapping means for fastening said beam to the door being reinforced to provide reinforcement without damaging the door's parts.

2. A door reinforcement apparatus comprising an upper mounting bracket having a first plate with one or more slots open at at least one end for insertion of fasteners to fasten said upper mounting bracket to the wall surface above the door being reinforced, and having a second plate perpendicularly connected to said first plate, said second plate having one or more holes;

a beam having one or more holes near its upper end for insertion of bolts when said holes are aligned with said hole(s) of said second plate of said upper mounting bracket, said beam further having an integral bottom mounting plate disposed perpendicularly to the rest of said beam at said beam's bottom end, said integral bottom mounting plate having one or more slots, said slots being open at at least one end with the exception of one said slot which is not open at its ends to provide a locking point when fastened, for insertion of fasteners to fasten said beam to the interior floor surface adjacent to the door being reinforced, such that said beam rests snugly against the interior surface of said door to provide reinforcement; and flexible strapping means for fastening said beam to the door being reinforced to provide reinforcement without damaging the door's parts.

3. A door reinforcement apparatus comprising an upper mounting bracket having a first plate with one or more slots open at at least one end for insertion of fasteners to fasten said upper mounting bracket to the wall surface above the door being reinforced, and having a second plate perpendicularly connected to said first plate, said second plate having one or more holes;

a beam having a vertical slot located near said beam's upper end for insertion of said second plate of said upper mounting bracket, said beam also having one or more holes near its upper end running perpendicularly to said vertical slot of said beam for insertion of bolts when said holes are aligned with said hole(s) of said second plate of said upper mounting bracket when said second plate of said upper mounting bracket is inserted through said vertical slot of said beam, said beam further having an integral bottom mounting plate disposed perpendicularly to the rest of said beam at said beam's bottom end, said integral bottom mounting plate having one or more slots, said slots being open at at least one end with the exception of one of said slots which is not open at its ends to provide a "locking point" when fastened, for insertion of fasteners to fasten said beam to the interior floor surface adjacent to the door being reinforced such that said beam rests snugly against the interior surface of said door to provide reinforcement;

and flexible strapping means for fastening said beam to the door being reinforced to provide reinforcement without damaging the door's parts.

* * * * *